US008056380B2

(12) United States Patent
Widen

(10) Patent No.: US 8,056,380 B2
(45) Date of Patent: Nov. 15, 2011

(54) CYLINDER LOCK UNIT WITH AN EXTRA LOCKING PIN

(75) Inventor: Bo Widen, Torshalla (SE)

(73) Assignee: Winloc AG, Zug Schweiz (CH)

( * ) Notice: Subject to any disclaimer, the term of this patent is extended or adjusted under 35 U.S.C. 154(b) by 0 days.

(21) Appl. No.: 12/420,378

(22) Filed: Apr. 8, 2009

(65) Prior Publication Data

US 2010/0126241 A1 May 27, 2010

(30) Foreign Application Priority Data

Nov. 24, 2008 (SE) ..... 0802466

(51) Int. Cl.
*E05B 19/06* (2006.01)

(52) U.S. Cl. ..... 70/493; 70/367; 70/369

(58) Field of Classification Search ..... 70/493, 70/367, 369, 357–361
See application file for complete search history.

(56) References Cited

U.S. PATENT DOCUMENTS 3,413,831 A * 12/1968 Crepinsek ..... 70/358
3,777,520 A * 12/1973 Crepinsek ..... 70/358
4,107,966 A * 8/1978 Schlage ..... 70/493
4,294,092 A * 10/1981 Haggstrom ..... 70/493
4,655,063 A * 4/1987 Foshee et al. ..... 70/419
7,181,941 B2 * 2/2007 Eden, Jr. ..... 70/493
7,647,798 B1 * 1/2010 Jones et al. ..... 70/358
2008/0276675 A1 * 11/2008 Herdman ..... 70/493
2009/0301149 A1 * 12/2009 Widen ..... 70/358

* cited by examiner

*Primary Examiner* — Kristina Fulton
(74) *Attorney, Agent, or Firm* — Birch, Stewart, Kolasch & Birch, LLP

(57) ABSTRACT

A cylinder lock unit is disclosed, with an elongate housing portion (2') extending outside and along a cylindrical bore, and the elongate housing being dimensioned for being accommodated in a structural part (S) to form a lock device, with a fixed external longitudinal configuration (L) fitting into the structural part. The elongate housing portion has a linear row of cylindrical holes (22'), registering with cylindrical chambers in a key plug having a key slot. The cylindrical holes are closely packed with mutual distances dimensioned in accordance with prescribed minimum standards, and at least one of the cylindrical holes (22'), located adjacent to one longitudinal end of the elongate housing portion (2'), has an inclined cylinder axis, so that, as compared to a lock unit with only mutually parallel cylinder hole axes in the linear row in the elongate housing portion, an extra cylindrical hole is accommodated in the linear row.

13 Claims, 2 Drawing Sheets

CYLINDER LOCK UNIT WITH AN EXTRA LOCKING PIN

FIELD OF THE INVENTION

The present invention relates to a cylinder lock unit comprising:

a housing having a cylindrical bore, a cylindrical key plug being rotatably journalled in said cylindrical bore, said key plug having a longitudinal key slot and a number of locking pins in associated cylindrical chambers in a linear row along a key plug axis for locking the key plug against rotation in the cylindrical bore, each locking pin in said linear row being guided for elevational movement in one of said associated cylindrical chambers in said key plug and having a key sensing part for contacting a key inserted into said key slot, said housing also including an elongate housing portion extending outside and along said cylindrical bore, said elongate housing portion being dimensioned for being accommodated in a structural part to form a lock device, with a fixed external longitudinal configuration fitting into said structural part, said elongate housing portion having a linear row of cylindrical holes, registering with said cylindrical chambers in the key plug, and said cylindrical holes accommodating upper pins, corresponding in number to said locking pins and cooperating with the latter so as to provide a locking function enabling or preventing rotation of said key plug in said cylindrical bore.

BACKGROUND OF THE INVENTION

In such cylinder lock units, normally being used in very large numbers as door locks and the like, it is important to provide many code combinations, so as to obtain a satisfactory security level of the lock device. Of course, the number of code combinations is dependent, among other things, on the number of cylindrical chambers (equal to the number of cylindrical holes and cylindrical locking pins in the linear row). Normally, in standard lock units, this number is six. A similar prior art lock unit, although the uppermost part of the elongate housing portion thereof is not shorter than the lowermost part of the lock, is known from U.S. Pat. No. 4,294,092.

OBJECT OF THE INVENTION

An object of the invention is to increase the number of cylindrical chambers and locking pins in the linear row, without changing the overall longitudinal dimensions of the lock unit. This should be achieved while maintaining the security level and robustness of the lock, so that it will stand attempts to manipulate or break the lock. In particular, the distances between the various cylindrical chambers should not be drastically reduced.

SUMMARY OF THE INVENTION

The above-stated object is achieved by a lock unit wherein:

the cylindrical holes are closely packed in said linear row within said fixed external longitudinal configuration (L), said cylindrical holes being closely packed with non-parallel axes such that at least the outermost cylindrical holes (22'), located adjacent to respective longitudinal ends of said elongate housing portion (2') lean with their upper parts towards a longitudinal centre portion of said elongate housing portion, at an inclinational angle in the interval 1°-10° relative to the central axis of the associated cylindrical chamber in the key plug, wherein the cylindrical walls defining each of said outermost cylindrical holes (22') in said elongate housing portion includes one side with an upper portion that is thinner than a lower portion thereof, and an opposite side with a lower portion that is thinner than an upper portion thereof, in a central longitudinal plane through the axes of said cylindrical holes in said elongate housing portion for reducing the overall length of the elongate housing portion; and all pairs of said cylindrical chambers in said key plug and said associated cylindrical holes in said elongate housing portion, even where the central axes in a pair are inclined relative to each other, register mutually so as to permit displacement of the associated locking pin (10') or upper pin (28') into the neighboring hole or chamber in order to provide said locking function, in spite of the inclination of said outermost cylindrical holes.

Thus, the longitudinal configuration and dimensions of the lock unit, in particular at the upper part of the elongate housing portion and in the rotatable key plug, can be utilized more effectively, so that a maximum number of cylindrical holes and chambers are accommodated in the lock unit. In this way, there will be room for one more cylindrical hole and chamber in the linear row, as compared to standard embodiments which have been used hitherto, e.g. seven cylindrical holes and chambers in the linear row, rather than six. Also, because of the inclinations of said at least one cylindrical hole, the remaining material thickness between this hole and the outer surface will be greater at the upper portion of the elongate housing.

This modification can be brought about without significantly changing the outer configuration or dimensions of the upper part of the lock unit. Therefore, it can be installed in standardized door lock devices and the like, without great modifications.

The invention will now be explained more fully below, with reference to the attached drawings, illustrating a preferred embodiment of the lock unit according to the invention.

DETAILED DESCRIPTION OF A PREFERRED EMBODIMENT

Figure 1:
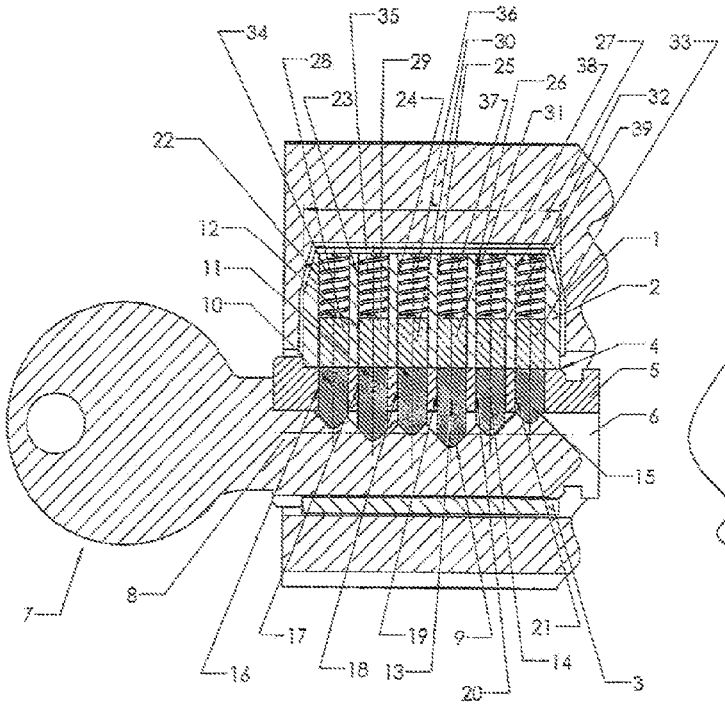
FIG. 1 shows, in a side view, partially in a longitudinal section (along line S1-S1 in FIG. 2), a prior art lock unit with a row of six locking pins.
Figure 2:
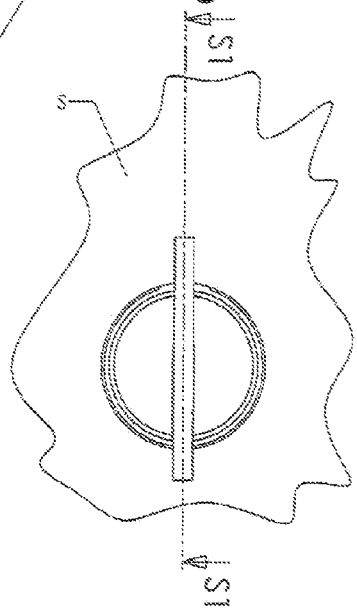
PRIOR ART Fig 2
FIG. 2 shows a front end view of the lock unit shown in FIG. 1.

The prior art lock unit shown in FIGS. 1 and 2 comprises a housing 1 with an elongate, substantially box-like housing portion 2 and a securely fastened (or integrally formed) cylindrical portion 3 having an internal cylindrical bore 4. Inside the latter, there is a cylindrical key plug 5 which is rotatably journalled in the cylindrical bore 4. The box-like housing 2 is elongated and extends along the upper side of the cylindrical portion 3. The lock unit 2,3,5 is mounted in a structural part S, such as a door knob, lever handle, pad lock, cabinet lock or the like, to form a lock device for the part S. Of course, the structural part S may be a door or some other device that may need to be locked by means of a lock cylinder unit.

In a manner known per se, the cylindrical key plug 5 has a longitudinal key slot 6, into which a key 7 with a key blade 8 is insertable. When a correct key 7 is inserted, as shown in FIG. 1, an upper key code 9 with cut out portions in the upper edge portion of the key blade 8, will cooperate with a number of locking pins 10,11,12,13,14,15 (six locking pins) such that the upper end surfaces of these locking pins lie flush with the shear line between the key plug 5 and the cylindrical bore 4. Accordingly, the key 7 and the key plug 5 is free to rotate in this position, for locking or unlocking the lock unit.

For this purpose, the locking pins 10-15 are mounted in corresponding cylindrical locking chambers 16-21, so as to be movable elevationally, i.e. up and down in FIG. 1. In the upper, elongate housing portion 2, there are corresponding cylindrical holes 22-27 with associated upper pins 28-33 therein. Each of upper pins 28 33 is also movable up and down and is biased by a pressure spring which exerts a downwardly directed force on the corresponding pair of pins 28-10, 29-11, 30-12, 31-13, 32-14, and 33-15. Spring 34 on upper pin 28-10 is shown in FIG. 1. The other upper pins are biased by springs similar to spring 34.

The lock unit 2, 3, 5 has a standard configuration and dimensions fitting into a fixed recess in the structural part S, e.g. a door knob or a lever handle, in particular in respect of the longitudinal configuration or measure of the elongate housing portion 2. In this case this measure L is 25.96 mm, which is a standardized measure. Generally this measure could fall in the interval 22 mm-30 mm, in particular 25 mm-27 mm. The central axes of the locking pins 10-15, and thus also the central axes of the cylindrical locking chambers 16-21, are spaced apart at equal distances 3.97 mm (centre to centre). The locking chambers 16-21 are aligned with the upper locking holes 22-27 when the key plug is positioned as shown in FIG. 1. The locking pins 10-15 and the upper pins 28-33 are thus movable together against the action of the pressure springs. In this way, a locking function is provided, enabling or preventing a rotational movement of the key plug 5 in the cylindrical bore, depending on whether the abutting surfaces of the pins 10-15 and 28-33 are located at the shear line (as shown in FIG. 1) or not.

Figure 3:
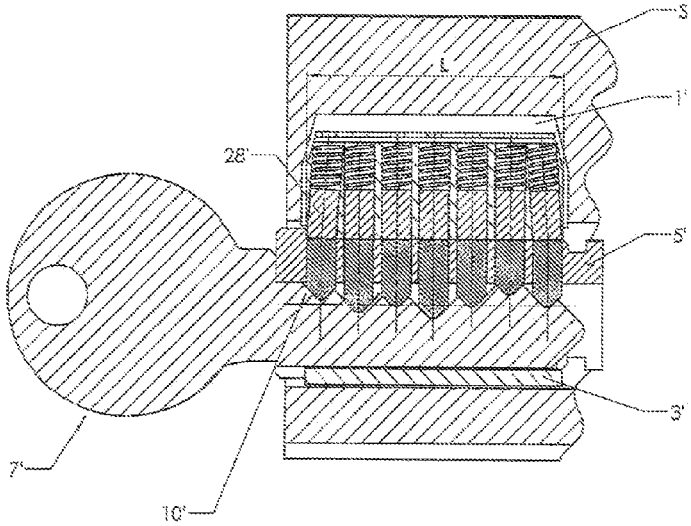
PRIOR ART Fig 3
FIG. 3 shows, in a side view corresponding to FIG. 1, a lock unit according to the invention with a row of seven locking pins.
Figure 4:
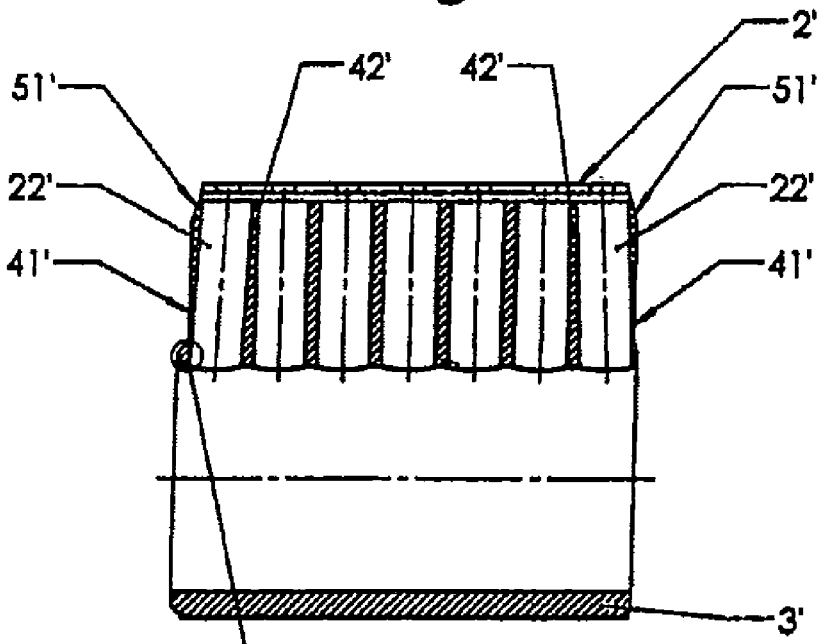
FIG. 4 shows a side view of the housing, without a key plug and without locking pins and upper pins, at a slightly larger scale.

Now, according to the invention, and as illustrated in FIGS. 3 and 4, the key housing 1' has an elongate, substantially box-like housing portion 2' and a securely fastened (or integrally formed) cylindrical portion 3'. Key plug 5' of key 7' and the elongate housing portion 2' are designed so as to accommodate one more locking pin (and associated upper pins, cylindrical chambers and cylindrical holes in the longitudinal linear row) by way of packing the cylindrical holes as close as permitted by normal standards, in accordance with prescribed minimum distances therebetween, and arranging at least one of the cylindrical holes adjacent to the longitudinal ends somewhat inclined, with an inclinational angle in the interval 1°-10°, preferably 2°-5°, and, in this particular case 3°. So, the number of locking pins 10' is seven, and the number of upper pins 28' is likewise seven. Each of the locking pins 10' in the linear row is guided for elevational movement in one of the associated cylindrical chambers in the key plug 5' and has a key sensing part 10*a* for contacting a key 7' inserted into the key slot. Of course, this is an example, and the same principle can be applied for a different number of locking pins in the linear row.

As will be seen more clearly in FIG. 4, the upper cylindrical holes 22', adjacent to the longitudinal ends of the elongate housing portion 2', are somewhat inclined in such a way that the central axes of the cylindrical chambers in the key plug 5' and the cylindrical holes in the housing portion 2' register smoothly with each other, and there is a continuous passage in the associated chambers and holes. However, there is a slight bend and inclination toward the middle portion (or centre point) of the elongate housing portion. The locking pins 10', as well as the upper pins 28', are somewhat rounded or bevelled at their end surfaces, so that they can move a certain distance past the shear line and perform a locking action, which prevents the key plug from rotating.

It will be seen from FIGS. 3 and 4 that, in spite of the extra locking pin and cylindrical chamber (and upper pin and cylindrical hole), the total length L of the elongate housing portion 2' is the same as in the prior art embodiment shown in FIG. 1, namely in the interval 22 mm to 30 mm, preferably 25 mm to 27 mm, in particular 25.96 mm. This has been made possible mainly by the inclined holes 22' adjacent to the ends of the elongate housing portion 2', but also because the wall thickness is as small as possible at diametrically opposite portions 41' and 42' (see FIG. 4), in a central longitudinal plane through the axes of the cylindrical holes 22' etc. in the elongate housing portion 2'. By limiting these thin wall portions to relatively small areas, the overall strength of the housing portion 2' will not be adversely affected.

In principle, it suffices to have an inclined hole at one end only, but the reduction of the longitudinal length will be greater in case the holes 22' are inclined at both ends of the housing portion 2'.

Theoretically, it would be possible to let the inclined hole 22' break through the wall to the adjacent hole, e.g. at the upper end, but in a preferred embodiment, the cylindrical walls of the cylindrical holes 22' are unbroken along the whole length of each cylindrical hole, as illustrated in FIG. 4.

Possibly, even the cylindrical holes next to the holes 22' at the ends may be somewhat inclined, preferably at a smaller inclinational angle than the holes 22' at the end. Accordingly, as an example, it would be possible to arrange all the cylindrical holes in the elongate housing portion with decreasing inclinational angles towards a centre point at half the length of the elongate housing portion.

It will also be seen from FIGS. 1 and 4 that the elongate housing portion 2 and 2', respectively, is bevelled at its opposite ends, so that the upper part of the elongate housing portion 2' is shorter than the lower part adjacent to the key plug 5'. The inclinational angle of these bevelled surfaces 51' is preferably greater than the inclinational angle of the cylindrical hole 22', e.g. with an angle in the interval 5° to 45°, or preferably between 10° and 20°.

Of course, the bevelled surfaces 51' and the inclined cylindrical holes 22' will both contribute to reducing the total length of the housing portion and utilizing the existing volume in an optimal way.

Figure 5:
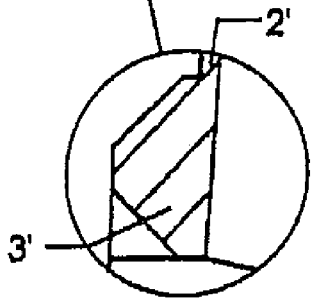
FIG. 5 shows a detail from FIG. 4.

In FIG. 5, there is shown an enforced portion of the transition between the cylindrical portion 3' of the housing and the elongate, box-like portion 2' of the housing. This enforcement will strengthen the structure and prevent damages even if the lock unit is subjected to careless or violent treatment during use. Such an enforced portion may be provided at one end or at both ends of the housing.

In the illustrated example, the distances between the adjacent cylindrical holes in the elongate housing portion 2' is very similar to the dimensions in the prior art embodiment, but somewhat smaller, namely in accordance with prescribed minimum distances therebetween, or 3.81 mm between the central axes of these holes adjacent to the cylindrical bore 4, as compared to 3.97 mm in FIG. 1. The diameter of each hole is 3.02 mm in this example.

It is a great advantage to accommodate one more locking pin in the linear row. The number of code combinations for the keys will increase considerably and, still, the same basic structure of the lock unit can be used, with similar pins and exactly the same standardized recess in the structural part (e.g. a door knob) where the lock unit is to be mounted.

Of course, the illustrated structure can be modified by those skilled in art, within the scope of the appended claims. For example, the bevelled parts 51' at the ends of the elongate housing portion 2 may be replace by rounded parts, or some other configuration which is more narrow upwards. The inclinational angles of the cylindrical holes 22' may vary, as long as they are mutually different and not all parallel. Moreover, the number of locking pins in the longitudinal, linear row may be less than 7 or greater than 7.

In the lock cylinder, there may be further locking tumblers, e.g. side tumblers cooperating with a key code at the side of the key blade. There may also be a side bar that locks the key plug from rotation, unless a correct key is inserted into the key plug.

Of course, the key may have any desired profile, with one or more longitudinal grooves, even undercut grooves.

The invention claimed is:

1. A cylinder lock unit comprising:

a housing (1') having a cylindrical bore (3'), a cylindrical key plug (5') being rotatably journalled in said cylindrical bore, said key plug having a longitudinal key slot and a number of locking pins (10') in associated cylindrical chambers in a linear row along a key plug axis for locking the key plug against rotation in the cylindrical bore, each locking pin in said linear row being guided for elevational movement in one of said associated cylindrical chambers in said key plug and having a key sensing part (10*a*) for contacting a key (7') inserted into said key slot, said housing also including an elongate housing portion (2') extending outside and along said cylindrical bore and having an uppermost part, said elongate housing portion being dimensioned for being accommodated in a structural part (S) to form a lock device, with a fixed external longitudinal configuration (L) fitting into said structural part, said elongate housing portion having a linear row of cylindrical holes (22'), registering with said cylindrical chambers in the key plug, and said cylindrical holes accommodating upper pins (28'), corresponding in number to said locking pins and cooperating with the latter so as to provide a locking function enabling or preventing rotation of said key plug in said cylindrical bore, wherein the cylindrical holes are closely packed in said linear row within said fixed external longitudinal configuration (L), said cylindrical holes being closely packed with non-parallel axes such that at least the outermost cylindrical holes (22'), located adjacent to respective longitudinal ends of said elongate housing portion (2') lean with their upper parts towards a longitudinal centre portion of said elongate housing portion, at an inclinational angle in the interval 1°-10° relative to the central axis of the associated cylindrical chamber in the key plug, wherein the cylindrical walls defining each of said outermost cylindrical holes (22') in said elongate housing portion includes one side with an upper portion that is thinner than a lower portion thereof, and an opposite side with a lower portion that is thinner than an upper portion thereof, in a central longitudinal plane through the axes of said cylindrical holes in said elongate housing portion for reducing the overall length of the elongate housing portion; and all pairs of said cylindrical chambers in said key plug and said associated cylindrical holes in said elongate housing portion, even where the central axes in a pair are inclined relative to each other, register mutually so as to permit displacement of the associated locking pin (10') or upper pin (28') into the neighboring hole or chamber in order to provide said locking function, in spite of the inclination of said outermost cylindrical holes .

2. A lock unit as defined in claim 1, wherein said inclinational angle is in an interval of 2° to 5°.

3. A lock unit as defined in claim 1, wherein said cylindrical walls are unbroken along a whole length of each cylindrical hole.

4. A lock unit as defined in claim 1, wherein other ones of the cylindrical holes in said linear row in said elongate housing portion are also inclined, although at a smaller inclinational angle than said two cylindrical holes located adjacent to the ends of said elongate housing portion.

5. A lock unit as defined in claim 4, wherein a number of cylindrical holes on each side of a longitudinal centre point of said elongate housing portion are inclined with increasing inclinational angles towards the respective end of said elongate housing portion.

6. A lock unit as defined in claim 1, wherein the number of cylindrical holes in said elongate housing portion is seven.

7. A lock unit as defined in claim 1, wherein said fixed length of said elongate housing portion is in an interval of 22 mm to 30 mm.

8. A lock unit as defined in claim 6, wherein said fixed length is in an interval of 25 mm to 27 mm.

9. A lock unit as defined in claim 1, wherein said mutual distances between any two adjacent cylindrical holes, centre to centre, is 3.81 mm.

10. A lock unit as defined in claim 1, wherein the elongate housing portion is bevelled on at least one of its opposite ends.

11. A lock unit as defined in claim 10, wherein an angle of the bevel is greater than said inclinational angle.

12. A lock unit as defined in claim 10, wherein an angle of the bevel is in an interval of 5° to 45°.

13. A lock unit as defined in claim 11, wherein the angle of the bevel is in an interval of 10° to 20°.

* * * * *